US010799891B2

(12) United States Patent
Fritze

(10) Patent No.: US 10,799,891 B2
(45) Date of Patent: Oct. 13, 2020

(54) COMPACT LINEAR OSCILLATING WATER JET

(71) Applicant: Karl J. Fritze, Hastings, MN (US)

(72) Inventor: Karl J. Fritze, Hastings, MN (US)

( * ) Notice: Subject to any disclaimer, the term of this patent is extended or adjusted under 35 U.S.C. 154(b) by 0 days.

(21) Appl. No.: 16/054,453

(22) Filed: Aug. 3, 2018

(65) Prior Publication Data

US 2020/0038890 A1 Feb. 6, 2020

Related U.S. Application Data

(63) Continuation of application No. 15/361,277, filed on Nov. 25, 2016, now Pat. No. 10,040,078.

(60) Provisional application No. 62/259,794, filed on Nov. 25, 2015.

(51) Int. Cl.

| | |
|---|---|
| ***B05B 3/16*** | (2006.01) |
| ***B05B 1/34*** | (2006.01) |
| ***B05B 3/04*** | (2006.01) |

(52) U.S. Cl.

CPC ..... *B05B 3/16* (2013.01); *B05B 1/3402* (2018.08); *B05B 3/0463* (2013.01)

(58) Field of Classification Search

CPC ... B05B 1/3402; B05B 3/0418; B05B 3/0463; B05B 3/14; B05B 3/16

See application file for complete search history.

(56) References Cited

U.S. PATENT DOCUMENTS

| | | | | |
|---|---|---|---|---|
| 4,732,325 | A | 3/1988 | Jensen | |
| 4,944,457 | A | 7/1990 | Brewer | |
| 4,989,786 | A * | 2/1991 | Kranzle | B05B 3/0463 239/240 |
| 5,108,035 | A | 4/1992 | Friedrichs | |
| 5,722,592 | A * | 3/1998 | Jager | B05B 3/0463 239/227 |
| 5,794,854 | A | 8/1998 | Yie | |
| 5,941,458 | A * | 8/1999 | Hartmann | B05B 3/0463 239/381 |
| 6,845,921 | B2 | 1/2005 | Schorn | |
| 7,770,820 | B2 | 8/2010 | Clearman | |
| 8,500,042 | B2 | 8/2013 | Brown et al. | |
| 2005/0164554 | A1* | 7/2005 | Cattaneo | B05B 1/3431 439/595 |

(Continued)

FOREIGN PATENT DOCUMENTS

| | | |
|---|---|---|
| EP | 2295148 A2 | 3/2011 |

OTHER PUBLICATIONS

Application and File History for U.S. Appl. No. 15/361,277, filed Nov. 25, 2016. Inventor: Karl J. Fritze.

*Primary Examiner* — Darren W Gorman

(74) *Attorney, Agent, or Firm* — Patterson Thuente Pedersen, P.A.

(57) ABSTRACT

A linear oscillating water jet is capable of spraying in a linear oscillating fashion without deviating from a consistent linear path such that a resulting linear spray does not extend beyond a targeted area. Through the use of an internal turbine, energy from an incoming pressurized liquid is used to create rotational motion, which is subsequently converted into an oscillatory, back and forth linear motion by way of a rocker assembly that connects a nozzle assembly to the internal turbine. The oscillatory, linear motion of the rocker assembly is translated into a linear, back and forth rocking motion for the nozzle assembly.

1 Claim, 8 Drawing Sheets

(56) References Cited

U.S. PATENT DOCUMENTS

2015/0273489 A1 10/2015 Harris et al.

* cited by examiner

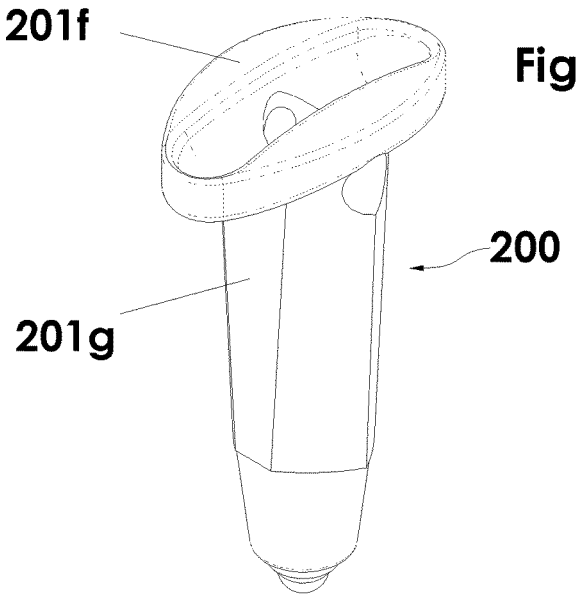
Fig. 5a
Fig. 5b
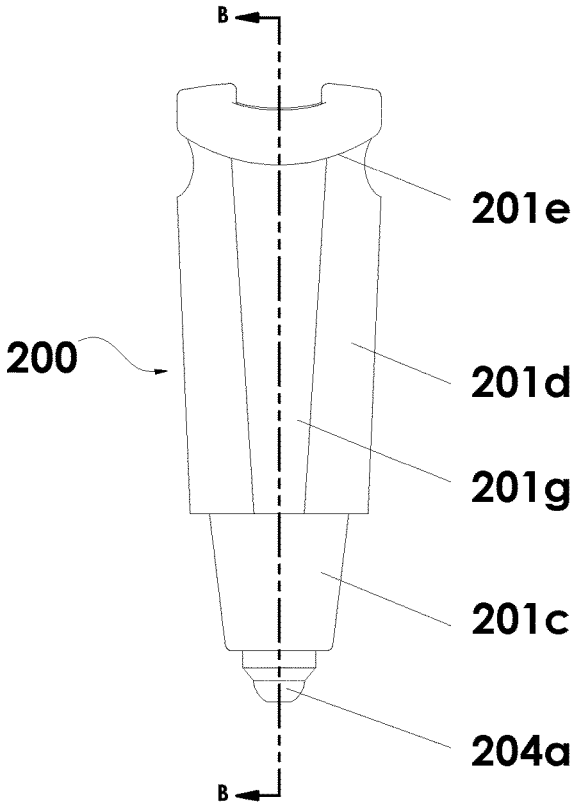
Fig. 5c
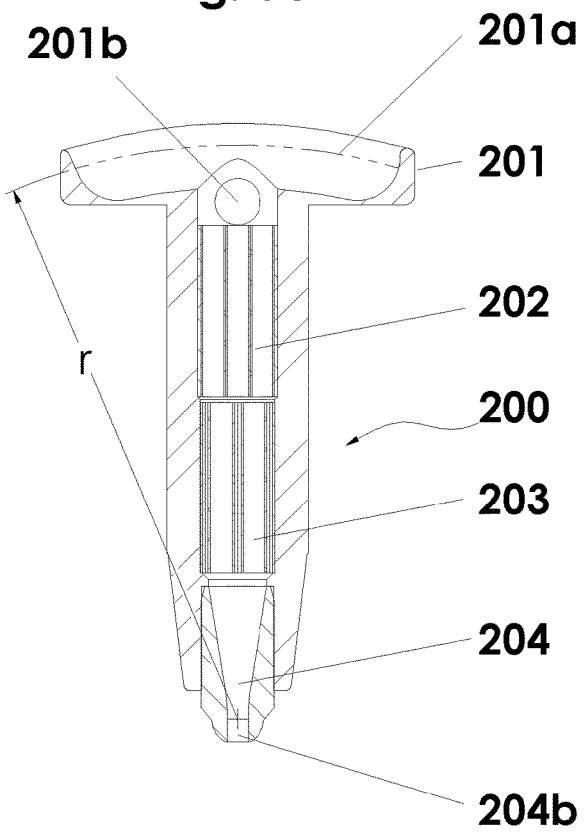

Fig. 7a
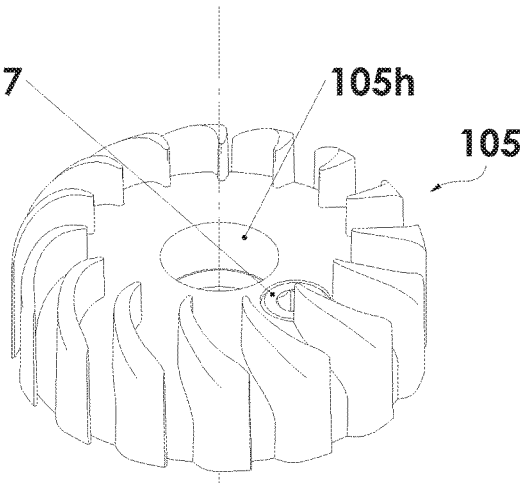
Fig. 7c
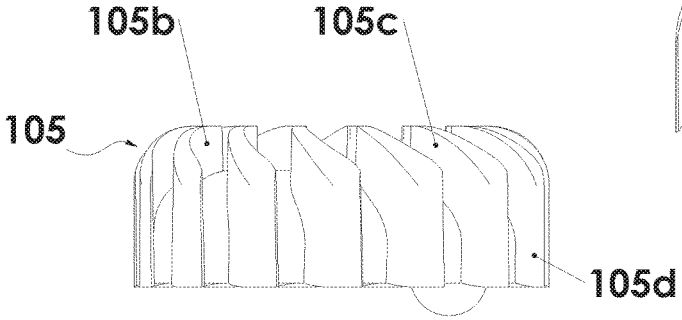
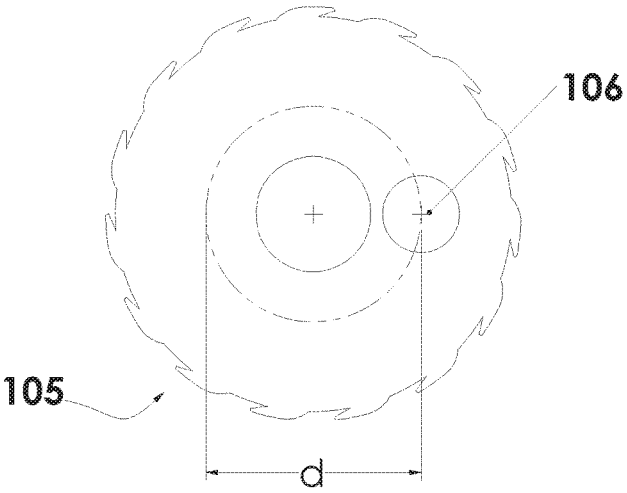
Fig. 7d
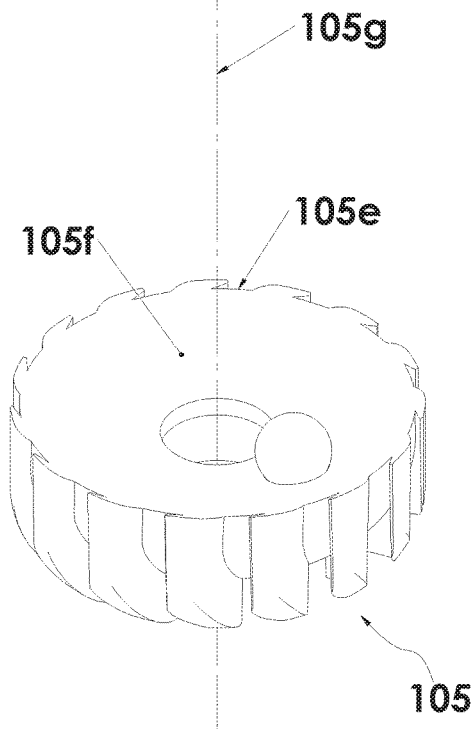
Fig. 7b

COMPACT LINEAR OSCILLATING WATER JET

CROSS-REFERENCE TO RELATED APPLICATION

The present application is a continuation of application Ser. No. 15/361,277, filed on Nov. 25, 2016, which claims priority to U.S. Provisional Application Ser. No. 62/259,794 filed Nov. 25, 2015 and entitled, "COMPACT LINEAR OSCILLATING WATER JET", which is hereby incorporated by reference in its entirety.

TECHNICAL FIELD

The present application is directed to a water jet assembly for use in cutting, excavation and cleaning. More specifically, the present application is directed to a compact water jet nozzle assembly that produces a linear oscillating spray pattern.

BACKGROUND

Conventional compact water jets typically used a fixed stationary orifice to produce a spray pattern that can produce a linear focused "spot spray or a fan-type spray pattern such as are used in typical pressure washer wands. This style of nozzle requires an operator to manually manipulate and move a spray wand back and forth as desired to cover and treat a desired area. With advances in automation, these types of static spray nozzles are often installed on platforms having external drive mechanisms which serve to move the nozzles in pre-determined patterns such as, for example, circular, or back and forth linear sweep patterns. Other nozzles have been developed to move the nozzle element internally in various patterns. One representative example is the compact rotary nozzle disclosed in U.S. Pat. No. 8,500,042 B2, which creates a conical spray pattern derived from an internal vortex and spinning rotating nozzle assembly. These nozzles and their various spray patterns are commonly found in automated car washes, for example.

While these water jet designs continue to be used successfully, it would be advantageous to improve upon their design. For example, it would be desirable to provide a water jet having a strong water jet spray pattern that can cover a wider area than a single, static water jet stream without requiring external mechanisms to provide oscillatory, reciprocation, or sweeping action.

SUMMARY

The Compact Linear Oscillating Nozzle of the present invention addresses these needs by automating the motion of the resulting water stream without degrading the stream integrity. Furthermore, the nozzle of the present invention is capable of spraying in a linear oscillating fashion without deviating from a consistent linear path such that a resulting linear spray does not extend beyond a targeted area. Through the use of an internal turbine, energy from an incoming pressurized liquid is used to create rotational motion, which is subsequently converted into an oscillatory, back and forth linear motion by way of a modified scotch yolk mechanism that connects the nozzle assembly to the internal turbine. The oscillatory, linear motion of the scotch yolk is translated into a rocking motion of the nozzle assembly. The pressurized liquid is directed into the nozzle assembly and is linearized by fluid straighteners, whereby the pressurized fluid is directed into and then exits a precision orifice jet. The resulting spray pattern from the precision orifice jet is a single, focused stream that oscillates back and forth in a consistent linear path with a nearly sinusoidal harmonic motion. By incorporating the linear oscillation structure internally, a water jet assembly is very compact and can be fitted into small spaces without requiring any external hardware to create the linear sweeping jet action.

In one aspect, the present invention is directed to a linear oscillating water jet. A representative linear oscillating water jet can comprise a shell defining an inlet and an outlet. The shell can enclose a turbine arranged to rotate about a fixed turbine axis in response to an incoming fluid flow. The turbine can be operably coupled to a rocker assembly, wherein the rotary motion of the turbine can be translated into a back and forth, linear oscillation within the shell. A fluid jet can exit the rocker assembly and be sprayed from the outlet in a linear, oscillating pattern. In some embodiments, the turbine can comprise a driving lug that orbits about the fixed turbine axis as the turbine rotates, and wherein the rocker assembly is operably coupled to the driving lug. In some embodiments, the shell can include a guide member extending fore and after across a cavity defined the shell. The guide member can be positioned through a guide channel in the rocker assembly such that the movement of the rocker assembly is constrained to operate along the path of the guide member.

In another aspect, the present invention can be directed to a method of creating a linear oscillating water jet spray pattern. The method can comprise a first step of supplying a fluid stream to an inlet of a water jet assembly. The method can further comprise driving a turbine to rotate about a fixed turbine axis within the water jet assembly by directing the fluid stream into contact with the turbine. The method can further comprise translating rotation of the turbine into a back and forth, linear oscillating motion for a rocker assembly. The method can further comprise spraying a water jet from rocker assembly such that water jet exits an outlet of the water jet assembly in a linear oscillating water jet spray pattern.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which:

FIG. 5*a* is perspective view of a rocker nozzle according to a representative embodiment of the present invention.

FIG. 5*b* is a side view of the rocker nozzle of FIG. 5*a*.

FIG. 5*c* is a section view of the rocker nozzle of FIG. 5*a* taken at line B-B of FIG. 5*b*.

FIG. 7*a* is a top, perspective view of a turbine assembly according to a representative embodiment of the present invention.

FIG. 7*b* is a bottom, perspective view of the turbine assembly of FIG. 7*a*.

FIG. 7*c* is a side view of the turbine assembly of FIG. 7*a*.

FIG. 7*d* is a bottom view of the turbine assembly of FIG. 7*a*.

Figure 1:
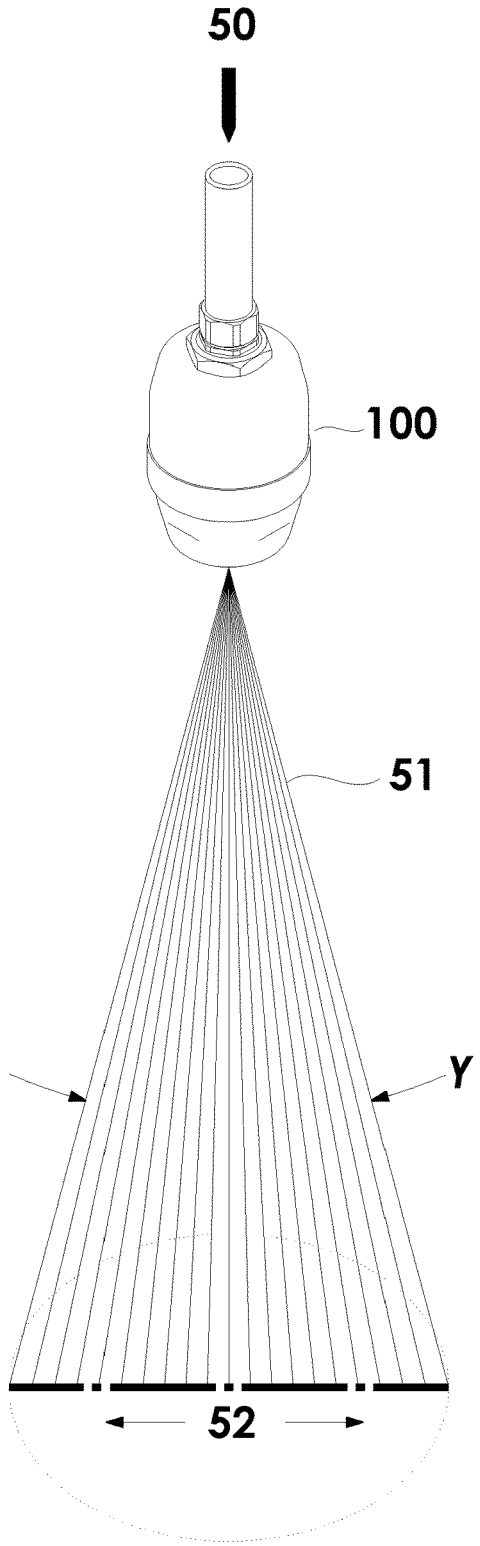
FIG. 1 is a perspective view of a water jet assembly according to a representative embodiment of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

A water jet assembly 100 supplied with inlet water 50 and its corresponding linear oscillating water jet spray pattern 52 is illustrated in FIG. 1. Inlet water 50 is provided to the nozzle assembly 100 under pressure. A resulting water jet 51 sweeps back and forth, side-to-side in a linear, sweeping path defined by angle α. This linear, sweeping path is the geometric result of effective length of an internal rocker assembly, r, and a turbine drive pin diameter d as will be described below. Generally, γ can be calculated by, and consequently designed to a have a desired linear sweeping path as determined by:

$$\gamma=2*\tan-1d/2r$$

Figure 2:
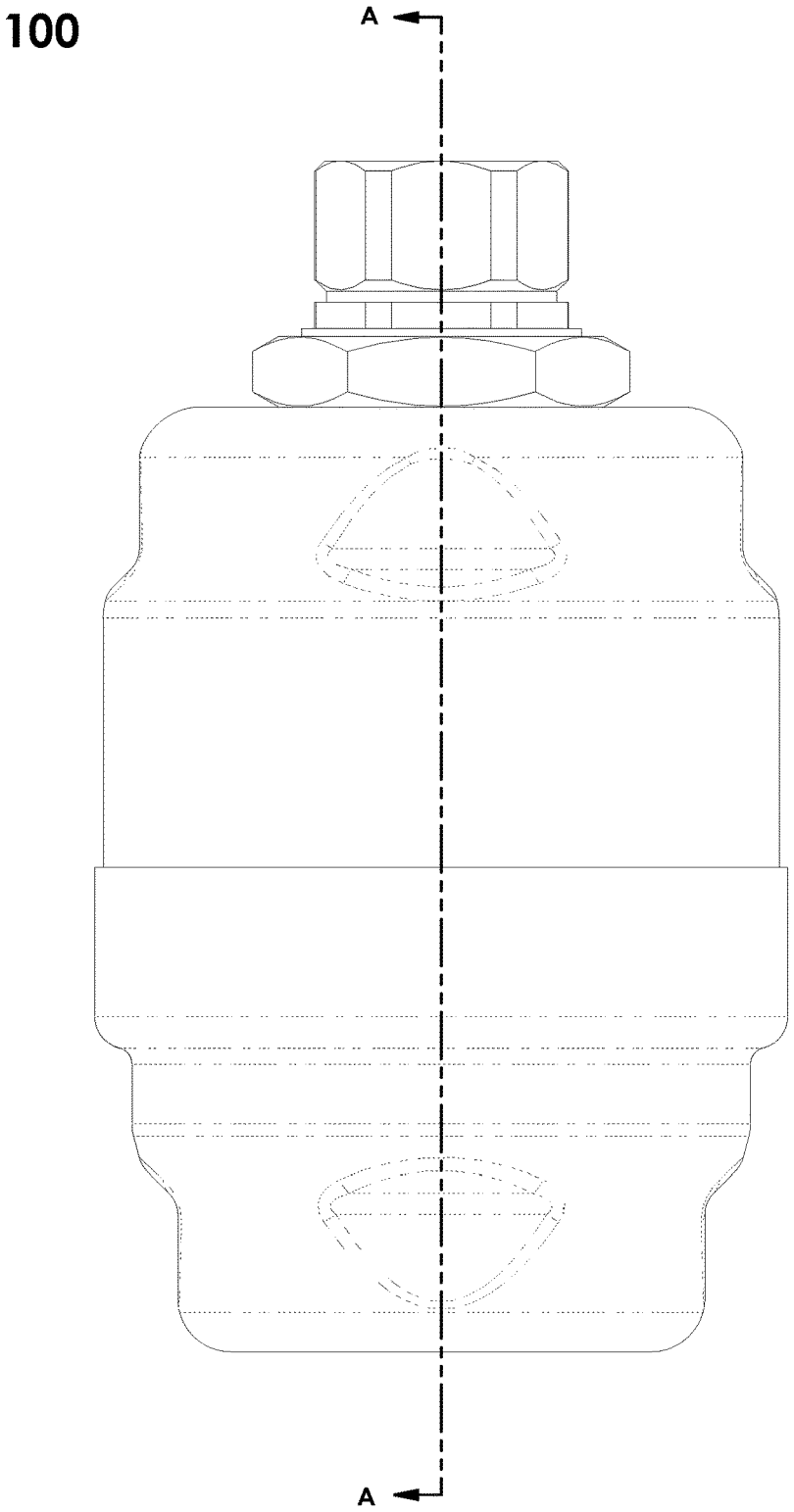
FIG. 2 is a side view of the water jet assembly of FIG. 1.
Figure 3:
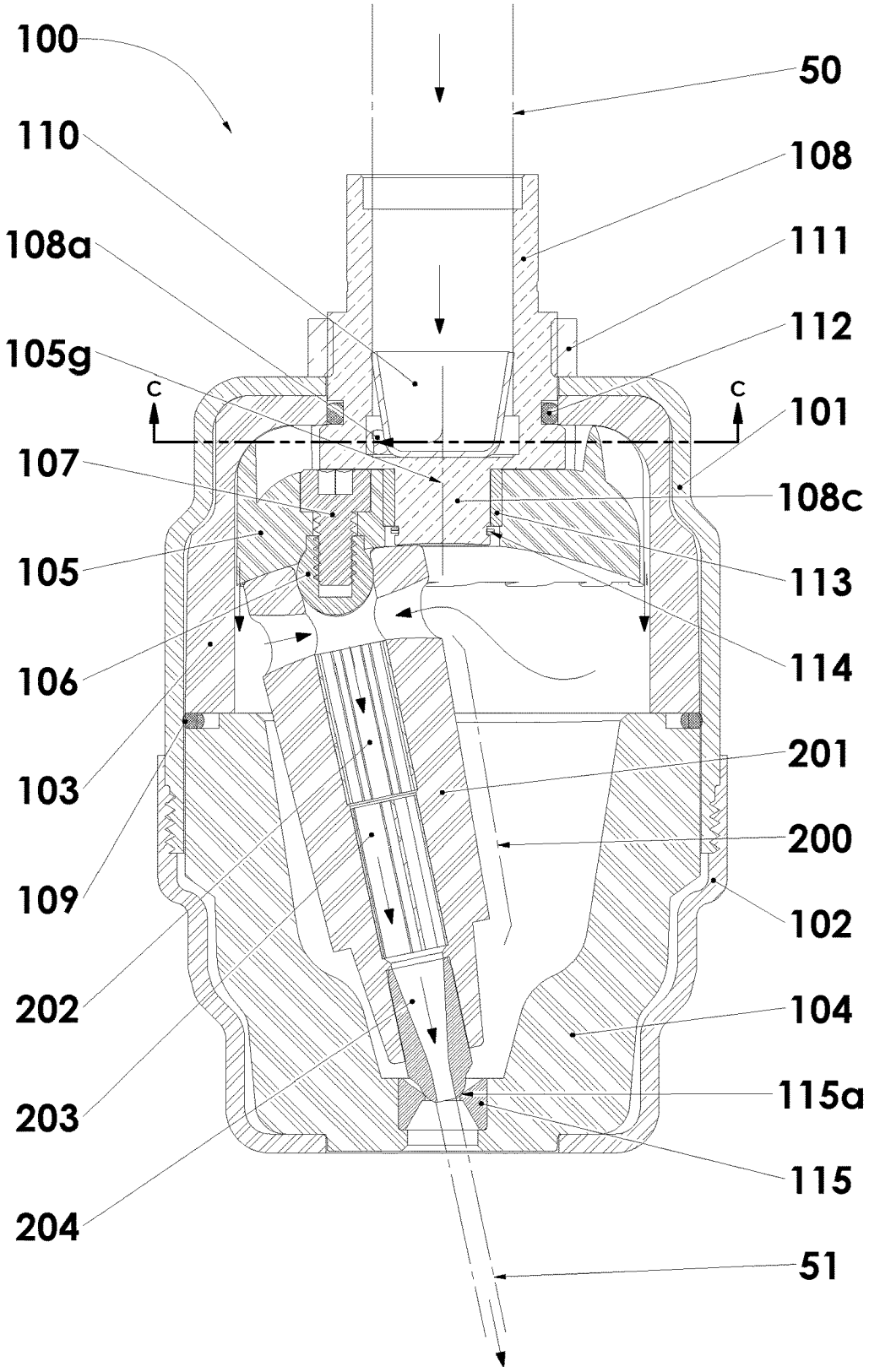
FIG. 3 is a section view of the water jet assembly of FIG. 1 taken at line A-A of FIG. 2.
Figure 4:
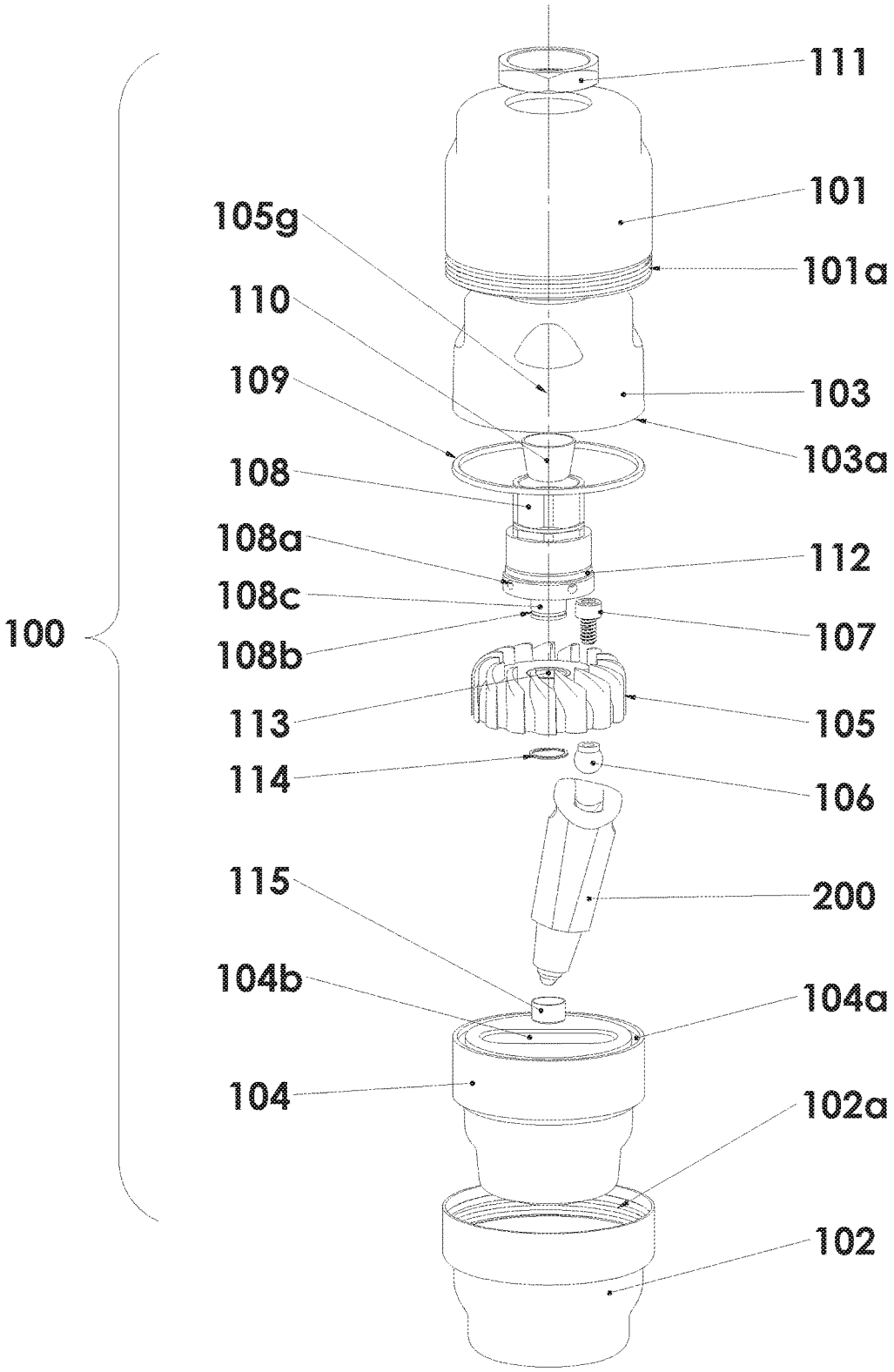
FIG. 4 is an exploded, perspective view of the water jet assembly of FIG. 1.

The water jet assembly 100 is illustrated in more detail within FIGS. 2, 3 and 4. Generally, water jet assembly 100 is comprised of an inlet outer housing 101 and outlet outer housing 102 which can be made from many different materials such as, for example, suitable polymers and metals. Due to its strength and corrosion resistance, stainless steel can be a preferred material for use in fabrication inlet outer housing 101 and outlet outer housing 102. Inlet outer housing 101 and outlet outer housing 102 can be manufactured to connect with various connection methods including, for example, welding, crimping, threading with a securing thread 101*a* and a securing thread 102*a*, clamping, molding, or retained by outside members as desired. In some embodiments, it is preferable that inlet outer housing 101 and outlet outer housing 102 utilize disconnectable connecting means such as threading or clamping so as to allow access for potential repair or replacement of internal members. Held within the inlet outer housing 101 and outlet outer housing 102 are an inlet shell 103 and outlet shell 104. Inlet shell 103 and outlet shell 104 cooperatively provide the internal geometry necessary to support the internal, wetted component and can be made from many different materials such as, for example, suitable polymers and metals. In some embodiments, polymeric materials are preferred do to their ease in molding and/or machining as well as their chemical compatibility, frictional characteristics, and lack of corrosion. Inlet shell 103 and outlet shell 104 can be constructed to have water-tight engagement though the use of a sealing surface 103*a*, a sealing surface 104*a* and sealing means 109 and 112, which can comprise o-ring seals or other suitable sealing methods. Alternatively, inlet outer housing 101 and outlet outer housing 102 can be constructed to have water-tight connections. Additionally, inlet shell 103 and outlet shell 104 can be designed to accommodate the full working pressure of the water jet assembly. Alternatively, the inlet outer housing 101 and outlet water housing 102 can be designed to accommodate all of the working pressure. In some embodiments, the inlet outer housing 101 and the outlet outer housing 102 can provide supplemental pressure integrity to the inlet shell 103 and outlet shell 104.

Figure 8:
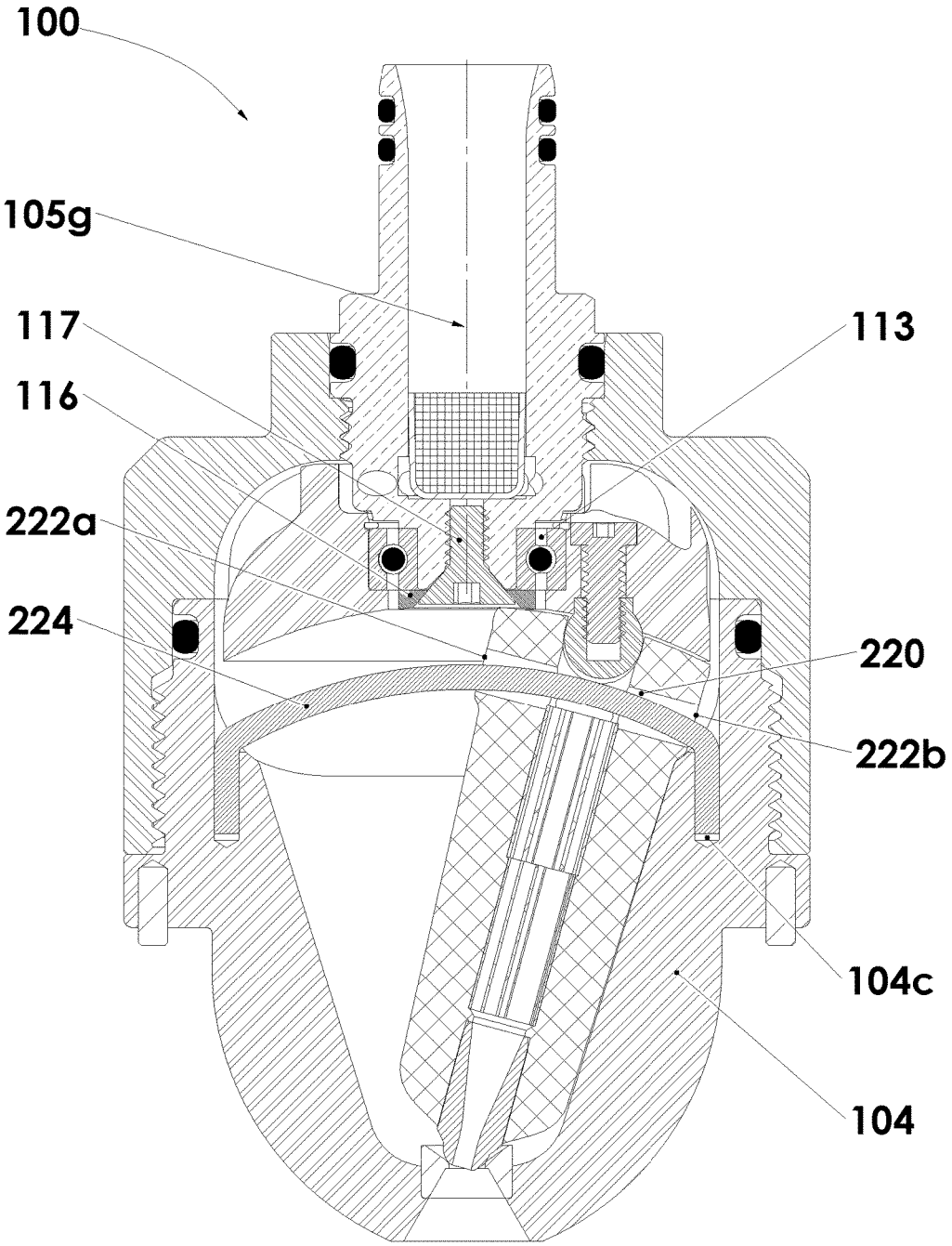
FIG. 8 is a section view of another representative embodiment of a water jet assembly of the present invention.

Inlet shell 103 is fabricated such that the internal geometry can retain a turbine 105 and inlet 108. The internal geometry of inlet shell 103 directs water from the inlet 108 to the turbine 105 so as to induce turbine rotation. Inlet 108 includes a bearing surface 108*c* that interacts with a bearing surface the turbine 105 so as to allow the turbine 105 to rotate freely relative to the inlet 108 constrained on turbine axis 105*g* without undue friction or drag. A retaining clip 114 attached to groove 108*b* keeps the turbine axially confined with respect to the turbine axis 105*g* while a bearing 113 formed of friction reducing material such as polyethylene, Teflon, UHMW-PE, (or other polymer materials), or brass or bronze and can include additional friction reducing materials such as molybdenum, graphite, Teflon and the like, promote free rotation of the turbine 105. Bearing 113 can provide a better wearing surface than the turbine 105 itself, or can be omitted if turbine 105 is fabricated to have a low-friction, low wear bearing surface 105*h*. FIG. 8 shows that Bearing 113 can also include rolling elements such as needles, cones, or balls as desired to reduce friction, retained by Washer 116 and Screw 117. Bearing Inlet 108 can be fabricated from brass, steel, stainless steel, PVC, ceramic, acetal, nylon, or other metals and polymers. Inlet 108 generally has a sealing surface to make a water tight joint with inlet shell 103 and sealing means 112. In some embodiments, pressurized inlet water 50 can be filtered using a replaceable mesh screen 110 so as to remove any particulate matter that would negatively impact the performance of the water jet assembly 100 or which could damage internal components within the water jet assembly 100. When inlet 108 is connected to a supply of pressurized inlet water 50, one or more jet apertures 108*a* direct the incoming water into the turbine blades as desired to develop a thrust vector relative to the turbine 105 such that the resulting interaction between the inlet water 50 imparts a force to the turbine blades and produces rotation of turbine 105 having sufficient torque and rpm to oscillate a rocker assembly 200. The inlet direction, volume, and velocity of inlet water 50 and the geometry of the turbine blades can be individually tailored for different rotational speeds of turbine 105 as desired. Turbine 105 can be molded of a polymer such as, for example, polyethylene, polypropylene, polyphenylene oxide, PVC, nylon, ABS, polycarbonate, Teflon, acetal, and the like or alternatively can be machined, sintered, or cast from metals such as brass, bronze, stainless steel, aluminum as desired. As the turbine 105, and more specifically, the individual turbine blades, can be subject to damaging contaminants such as, for example, particulate matter such as sand or other abrasive particulate matter, turbine 105 is preferably formed of lightweight polymeric materials, such as polyethylene, that can be injection molded and possess desired material traits including durability, toughness and chemical/water resistance.

Driving lug 106 (also called a crank pin) is caused to rotate at a constant velocity about a specific diameter (d) by the turbine. Driving lug 106 preferably has a round configuration with crowned sides or spherical surfaces to contact a rocker yoke 201*a* tangentially at all times as it pivots about a spherical sealing bearing 204*a* on a spherical ball 204*b* of orifice 204 and radius of conical surface 115*a* in outlet bearing 115. Outlet bearing 115 can be formed of silicon or tungsten carbide for its hardness, corrosion resistance, and to possess a long wearing surface. Outlet bearing 115 can be press-fit into a receiving pocket in shell 140. Driving lug 106 can be an integral part of turbine 105, or a separate component as shown. If the driving lug 106 is made from a different material such as, for example, stainless steel, it can be fastened to turbine 105 using a suitable fastening means such as threaded screw 107. Alternately, driving lug 106 can be tapped into the turbine 105, or over molded as an insert, or attached using rivets or installed with a press fit. A nut 111 holds the inlet 108 tightly to housing 112.

Rocker assembly 200 is generally comprised of a rocker body which can be molded out of plastic such as polyethylene, polypropylene, polyphenylene oxide, PVC, nylon, ABS, polycarbonate, Teflon, acetal, Teflon modified acetal and the like. Flow straighteners 203 and 202 are long narrow conduits within the rocker assembly 200 for removing the swirl from the water flow and cause the water to be straightened as it enters an outlet orifice 204. Outlet orifice 204 has a conical receiving end which converges into a straight portion at the desired orifice diameter. Pressurized water exits the outlet orifice in a jet stream 51 along a center longitudinal axis of orifice 204. As the rocker assembly 200 oscillates, jet stream 51 oscillates in axial alignment with outlet orifice 204.

As illustrated in FIG. 4, outlet shell 104 includes a pocketed slot 104*b* which constrains the rocker assembly 200 to only pivoting in a plane parallel to the slot walls of pocketed slot 104*b*. Rocker assembly 200 includes generally flat sides 201*g* which align with the slot walls of the pocketed slot 104*b*, which serve to prevent the rocket assembly 200 from twisting during operation.

Rocker assembly 200 is shown in further detail in FIG. 5. Rocker assembly 200 can be molded or machined with an integral yoke 201 which allows the drive lug 106 to maintain tangential contact at all times. Drive lug 106 rotates while rocker assembly 200 pivots causing a curvilinear path of radius (r) 201*a* within the integral yoke 201. Rocker assembly 200 can include a variety of unique features to enable efficient hydrodynamic performance while maintaining structural integrity. As the rocker assembly 200 oscillates back and forth, the water is displaced and imparts fluid friction to the rocker motion requiring greater turbine driving torque while also limiting oscillation frequency. Leading edges 201*d* of the rocker assembly 200 can be angled or sharpened to allow a more streamlined shape and a yoke bottom surface 201*e* can be foil-shaped which helps increase oscillation frequency. A conical nose 201*c* on rocker assembly 200 requires less space as it angles back and forth during oscillation. A plurality of water ports 201*b* provide a pathway for water to be directed into the rocker assembly 200. The orientation of the water ports 201*b* can be fore and aft of the rocker assembly 200 as it pushes water both directions during oscillation allowing the water to be rammed into the rocker assembly 200. Rocker assembly 200 allows for internal flow straighteners to be integrally molded or press fit as desired. The flow straighteners are generally tubular and preferably have a diameter to length ratio of 10:1 to ensure the flow is straightened. The flow straighteners can include multiple stages, for example, larger tubes followed by smaller tubes as illustrated. Tubes can have any of a variety of cross sections including, for example, round, square, and hexagonal. When the flow straighteners are press fit into the rocker assembly 200, the flow straighteners can be made of materials including metal, brass, aluminum, stainless, or even extruded polymers.

Figure 6:
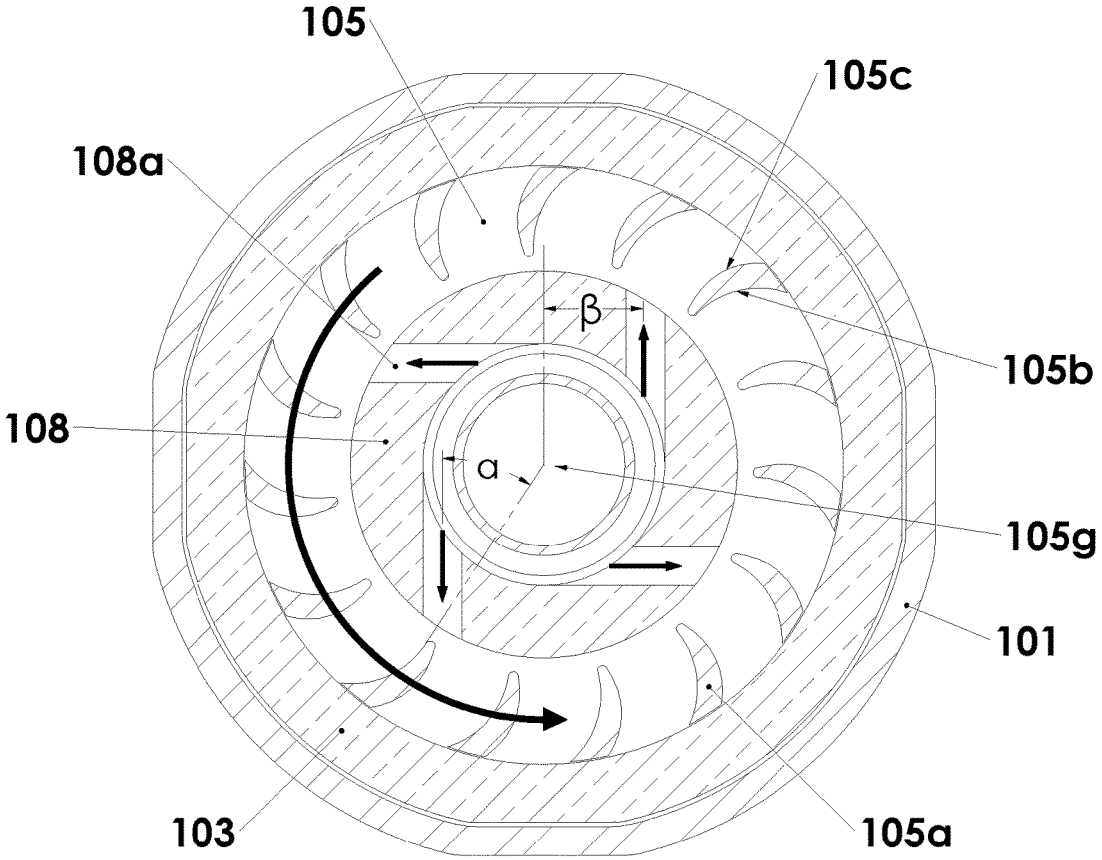
FIG. 6 is a section view of the water jet assembly of FIG. 1 taken at line C-C of FIG. 3.

As illustrated in FIG. 6, turbine 105 includes individual turbine blades 105*a* each having a vane pressure face 105*b* and a vane vacuum face 105*c*. Inlet shell 103 generally defines a close fitting cavity which contains and forces inlet water 20 to be directed into the turbine blades 105*a* causing rotation of the turbine 105. The geometry of the individual turbine blades 105*a* can be tuned for a desired rotational speed and torque by the shape and numbers of the turbine blades 105*a*. In particular, the jet to blade angle $\alpha$, can be adjusted to be neutral, positive, or negative. A neutral blade angle would cause the turbine 105 to be stationary and not rotate, while a positive angle would cause a forward rotation shown as counterclockwise. It is also possible to change the angle of the inlet jet aperture 108*a*. The angle of inlet jet aperture 108*a* is shown as being tangential to the internal wall of the inlet bore which causes a net swirl in a counterclockwise rotation. Changing this jet to blade angle $\alpha$, and an offset distance $\beta$ also allow for tuning an oscillation speed of the rocker assembly 200. The number of jet apertures 108*a* can also be used change the speed/torque characteristics of the turbine 105. As such, oscillation speeds for example, faster or slower oscillation of the rocker assembly 200, can be adjusted in a variety of ways.

As illustrated in FIGS. 7*a*-7*d*, turbine blades 105*a* receive a flow of pressurized inlet water 50 which interact with the turbine blades 105*a* to cause rotation of the turbine 105. Water flow is initially directed to the center of the turbine via the inlet 108. Inlet 108 has a plurality of water jet apertures 108*a* which can be sized for a desired water velocity. The higher the water velocity, the faster the turbine 105 can spin as water exits fluid exit 105*e*. Alternately, slow water velocity can slow down the rotational velocity of the turbine 105. The turbine blades shown here are of a radial design. The water flow transitions into an axial direction to move the water into the chamber where the rocker assembly 200 oscillates back and forth. The shape of the turbine blades 105*a* as shown are straight and do not continue to impart rotational motion. Alternatively, a blade pitch or helix can be added to an axial portion 105*d* to increase turbine torque as desired. Preferably, turbine 105 is fabricated by injection molding to keep components costs low. In some embodiments, a counter weight can be added opposite the drive lug 106 to reduce vibration of the water jet 100. Alternatively, material can be removed from the turbine from a location proximate the drive lug 106. As illustrated, turbine 105 has a separate drive lug 106 and fastener 107, though it will be understood that these components could be fabricated as a single, integral component. A turbine concave spherical surface 105*f* can provide a sliding bearing surface to a rocker yoke convex surface 201*f* The gap between these two concentric surfaces can be adjusted to keep outlet spherical ball 204*b* in contact with radius of conical surface 115*a* of outlet bearing 115. Controlling this gap ensures that the rocker assembly 200 will remain engaged in its pivot bearing during start-up and prevent bypass leaks during operation.

As an example, if the outlet orifice 204 is sized to a #6 size (0.062" diameter), the water jet assembly 100 will spray 3.0 gallons per minute at 1000 psi. If the jet apertures are sized to (4) 0.125" diameter holes, the flow rate will be 0.75 gpm per hole. The resulting jet aperture flow velocity is 14,117 inches per minute which is about 13.3 miles per hour. Given a turbine outer diameter of 1.35", the maximum rpm possible without drag or friction loss is 3329 rpm. Increasing the hole size to 0.187" and increasing the number to (8)

decreases the maximum rotational speed to 416 rpm. It can be understood that neutral blade angles can cause the turbine to stall to 0 rpm. In some embodiments, it can be desirable to allow the turbine 105 to operate at a slower speed to increase spraying contact time, and reduce internal forces and frictional wear inside the water jet assembly 100.

In another representative embodiment of the water jet assembly 100 as shown in FIG. 8, the rocker assembly 200 can be fabricated to include a guide channel 220 between fore and aft sides 222*a*, 222*b* of the rocker assembly 200. The outlet shell 104 can further comprise a guide member 224 extending fore and aft across the internal cavity of the outlet shell 104 being fixed within pockets 104*c*. The rocker assembly 200 can be mounted in the outer shell 104 such that the guide member 224 is received through the guide channel 220. As such, oscillation of the rocker assembly 200 is restrained and contained to operate solely in a linear manner.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A linear oscillating water jet, comprising:

a shell defining an inlet and an outlet;

a turbine mounted within the shell to receive a fluid flow from the inlet, the turbine rotating along a fixed turbine axis within the shell in response to the fluid flow; said turbine having a driving lug orbiting in circular motion about the fixed turbine axis; and a rocker assembly operably coupled to the turbine driving lug, the rocker assembly interfacing with the shell such that the rocker assembly moves fore and aft in a linear fashion, wherein rotation of the turbine is translated into a back and forth oscillation of the rocker assembly such that a linearly oscillating fluid jet is directed through the outlet; and wherein the shell includes a guide member and the rocker assembly includes a guide channel, wherein the guide member resides within the guide channel such that the rocker assembly oscillates in a linear direction along the guide member.

* * * * *